US007387710B2

(12) United States Patent
Bengtsson

(10) Patent No.: US 7,387,710 B2
(45) Date of Patent: Jun. 17, 2008

(54) SHOE PRESS

(75) Inventor: Roland Bengtsson, Karlstad (SE)

(73) Assignee: Metso Paper, Inc., Helsinki (FI)

( * ) Notice: Subject to any disclaimer, the term of this patent is extended or adjusted under 35 U.S.C. 154(b) by 485 days.

(21) Appl. No.: 11/143,248

(22) Filed: Jun. 2, 2005

(65) Prior Publication Data

US 2005/0274476 A1 Dec. 15, 2005

(30) Foreign Application Priority Data

Jun. 11, 2004 (EP) ..... 04102661

(51) Int. Cl.
*D21F 3/02* (2006.01)

(52) U.S. Cl. ..... 162/358.3; 162/153; 162/156

(58) Field of Classification Search ..... 162/205, 162/206, 358.1, 358.3, 358.4; 100/37, 118, 100/121, 153, 156, 170; 492/7, 20
See application file for complete search history.

(56) References Cited

U.S. PATENT DOCUMENTS 5,099,750 A * 3/1992 Rebel ..... 72/12.2
5,223,100 A 6/1993 Schiel et al.
6,083,352 A 7/2000 Snellman et al.
6,387,219 B2 * 5/2002 Snellman ..... 162/358.3
2003/0015306 A1 * 1/2003 Aho et al. ..... 162/358.3

FOREIGN PATENT DOCUMENTS

DE 44 02 595 A1 7/1994
WO WO 00/68497 * 11/2000
WO WO 01/98584 * 12/2001

* cited by examiner

*Primary Examiner*—Eric Hug
(74) *Attorney, Agent, or Firm*—Stiennon & Stiennon

(57) ABSTRACT

A shoe press 1 for applying pressure to a fibrous web W has a concave press shoe 2 adapted to be juxtaposed with a backing member 6. A plurality of articulated hydraulic actuators 5 are spaced apart in the cross-machine direction along the press shoe 2 to press the shoe toward a backing member. The actuators have first and second cylinders and a piston. The pistons and the cylinders have spherical surfaces adapted to be able to cooperate with each other.

12 Claims, 8 Drawing Sheets

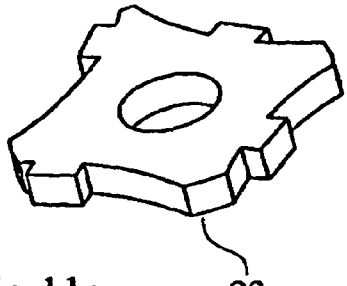
Fig.11a
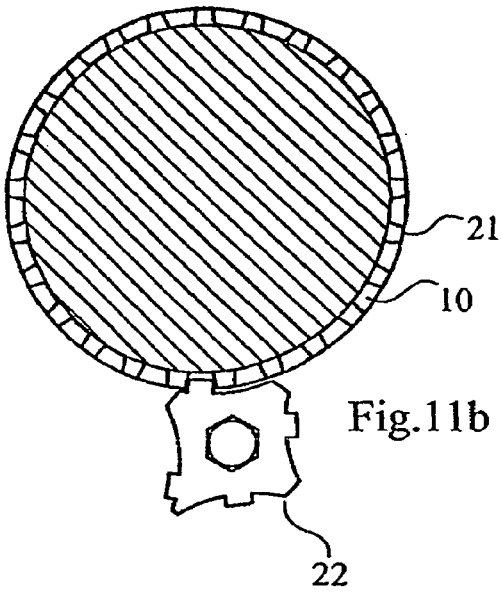
Fig.11b
Fig.12
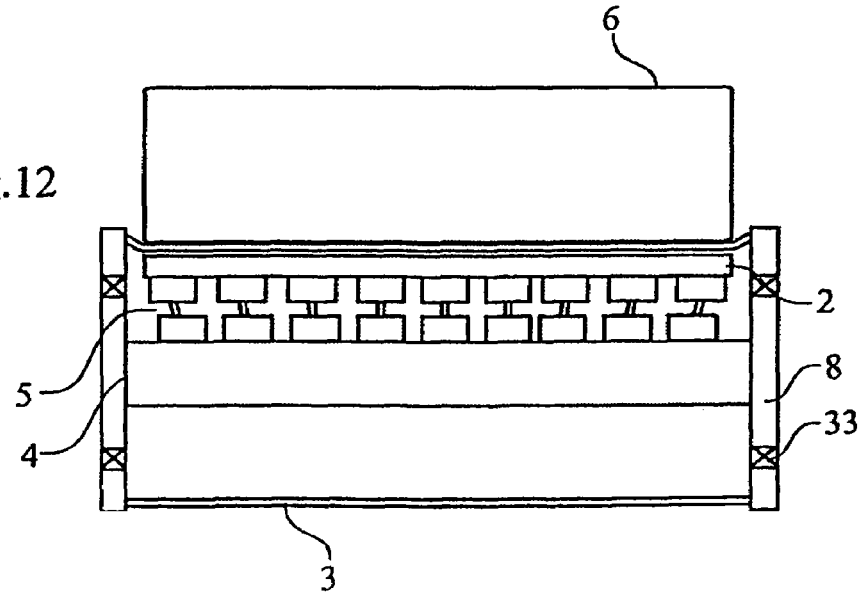

SHOE PRESS

CROSS REFERENCES TO RELATED APPLICATIONS

This application claims priority on European Patent App. No. 04102661.8, Filed Jun. 11, 2004, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to shoe presses for applying pressure to a running web of paper, paperboard, or the like. More particularly, the present invention relates to a shoe press of the type having a support which supports a press shoe adjacent to a cylindrical backing member such that the press shoe and backing member form an extended nip therebetween, and having a hydraulic device for urging the press shoe toward the backing member to apply pressure to the web running through the nip. The shoe press of the present invention can be used for example as a dewatering press in the press section of a paper or paperboard machine, as an extended nip calender or in a tissue machine where the backing member is formed by a Yankee dryer.

In a papermaking machine, a wet web of paper or the like from the forming section of the machine is typically carried through the nip of a shoe press of the above-described type, where the web is pressed between two layers of absorbent felt or the like for wicking moisture from the web. Such shoe presses can also be used for other purposes than dewatering. For example, a shoe press can be used as an extended nip calender. In an extended nip calender, the backing member may be a roll provided with heating means, e.g. an induction heater or internal channels for heated oil. When a shoe press is used in a tissue machine, the backing member may be a Yankee dryer. When a shoe press is used in the press section of a paper or paperboard machine to press water from a wet web, the backing member may be, for example, a deflection-compensated roll.

One of the difficulties encountered in shoe presses is thermal expansion of the shoe from frictional heating of the shoe by the belt that carries the paper web through the press, as well as from hot hydraulic fluid which is circulated through the shoe for various purposes. Thermal expansion of the shoe causes elongation of the shoe in the cross-machine direction. The shoe is typically urged by a hydraulic device toward the backing member. The hydraulic device may be formed by a pressure chamber which extends in the cross-machine direction the whole length of the shoe. The pressure chamber is limited by the press shoe at the radial outside of the chamber and a shoe bed beneath the shoe which rests on a stationary support member of the shoe press roll. Such a shoe press is disclosed in, for example, DE 44 02 595. However, the majority of the shoe presses that are currently produced are instead provided with a plurality of hydraulic cylinders that extend in the cross machine direction in one or several rows. In such a shoe press, the hydraulic cylinders must be able to allow thermal expansion of the shoe without damage to the cylinders and/or the shoe. Moreover, the operation of the shoe press must not be disturbed. In U.S. Pat, No. 6,083,352, a shoe press is disclosed that comprises a plurality of articulated hydraulic loading cylinders that are spaced apart in the cross-machine direction along the press shoe. Each loading cylinder includes a piston member disposed within a cylinder. One of the piston and cylinders comprises a two-piece member having a first member fixed relative to the press shoe and a second member fixed relative to the support and spaced from the first member. The other of the piston and cylinders comprises a coupler engaging both the first and second members. The coupler engages the respective first and second members at seals which enable the coupler to pivot relative to the first and second members about axes parallel to the machine direction. Thereby, the articulated hydraulic loading cylinders enable the press shoe to move in the cross-machine direction relative to the support.

For shoe presses, it can also be a problem that the hydraulic device or devices used for urging the press shoe toward a counter member can become pressurized even when no backing member is present. In U.S. Pat. No. 5,223,100, a shoe press is disclosed that has a shoe bed with a pressure chamber and a connecting element disposed between the shoe bed and a side of the press shoe. It is stated that the connecting element prevents the press shoe from unintentionally escaping from the shoe bed, for instance, under pressure prevailing in the pressure chamber or under the force of gravity. It is stated that the connecting element may include an auxiliary piston which is part of an additional cylinder-piston unit. A cylinder of the unit is fastened to the outside of the shoe bed. The auxiliary piston and the piston fastened to the shoe bed are described as forming a pair of stop surfaces that limits the stroke of the press shoe.

It is an object of the present invention to provide an improved shoe press with a plurality of hydraulic actuators spaced apart in the cross-machine direction that can accommodate thermal expansion of the shoe in the cross-machine direction and simultaneously allow pressurization of the hydraulic actuators even when no backing member is present. It is also an object of the invention to provide a shoe press that is easy to assemble and that allows easy access for service purposes. These and other objects of the invention are attained with the shoe press according to the present invention.

SUMMARY OF THE INVENTION

The present invention relates to a shoe press for applying pressure to a fibrous web. The shoe press comprises a concave press shoe adapted to be juxtaposed with a backing member such as for example a deflection compensated roll or a Yankee dryer such that the web can be carried through a nip defined therebetween. The press shoe extends in a cross-machine direction along substantially a full width of the web. The shoe press further comprises a support which supports the press shoe. The support can be, for example, a cast beam or a welded box-beam. A plurality of articulated hydraulic actuators are arranged on the support and spaced apart in the cross-machine direction along the press shoe such that the press shoe is movable in a loading direction toward the backing member for applying pressure to the web. At least one actuator includes a first cylinder connected to the press shoe, e.g. fixed relative to the press shoe, a second cylinder connected to, e.g. fixed to the support and a piston member having a first end received within the first cylinder and a second end received within the second cylinder. The piston ends have convex spherical surfaces and the cylinders have seats with concave spherical surfaces with a curvature that may correspond to the curvature of the piston ends. It should be understood that the curvature of the convex surfaces can be equal to the curvature of the concave spherical surfaces but that the curvature can also differ. For example, the radius of curvature of the convex surfaces may be somewhat smaller than the radius of curvature of the concave surfaces.

The piston sealingly engages both the first and second cylinders. The first cylinder is urged away from the second cylinder when the actuator is pressurized. The spherical surfaces of the piston ends allow the piston to pivot about axes parallel to the machine direction. In this context, the machine direction should be understood as the main direction of travel of the web through the nip. In other words, the piston can be inclined relative to the loading direction of the actuators. The concave spherical surfaces of the cylinders are arranged/adapted to be able to cooperate with the spherical surfaces of the piston ends to prevent the piston ends from leaving the cylinders but allow the piston to be inclined relative to the loading direction of the actuators even at fill stroke, i.e. when the actuators are at the limit of their stroke. This allows the piston to reach its end position when the piston is inclined because of thermal expansion of the shoe but the actuator can still take its own force due to the cooperating spherical surfaces of the piston ends and the cylinder seats. The cooperating spherical surfaces of the piston ends and the cylinder seats can distribute the force of the actuator over a larger area and thereby prevent damage to the actuator.

In preferred embodiments of the invention, the piston is divided in two parts adapted to be connected to or disconnected from each other.

Advantageously, each of the articulated cylinders has a first cylinder connected or fixed relative to the press shoe, a second cylinder connected or fixed relative to the support and a piston member having a first end received within the first cylinder and a second end received within the second cylinder, the piston ends having convex spherical surfaces and the cylinders having seats with concave spherical surfaces with a curvature substantially corresponding to the curvature of the piston ends so that the pistons are able to pivot about axes parallel to the machine direction but prevented pistons from leaving the cylinders.

Preferably, the piston(s) is/are provided with a through-hole such that the first cylinder(s) is/are in fluid communication with the second cylinder(s).

In preferred embodiments of the invention, the second cylinder has a serrated outer circumference.

The second cylinder may be rotated into locking engagement with the support such that the serrated outer circumference of the second cylinder is located at a lower end of the second cylinder adjacent the support. A fastener may then be removably secured to the support such that it engages the serrated outer circumference to prevent rotation of the second cylinder relative to the support.

In advantageous embodiments, each of the first and second cylinders may comprise an internal cylinder part and an external cylinder detachably secured to each other. The concave spherical surface of at least one cylinder is located on a part of the external cylinder. Preferably, the concave spherical surface of each cylinder is located on a part of the external cylinder.

Preferably, at least one of the cylinders may be provided with a venting opening.

Further objects, features and advantages of the invention will be apparent from the following detailed description when taken in conjunction with the accompanying drawings.

BRIEF DESCRIPTION OF THE DRAWINGS

FIG. 11*a* is a perspective view of a fastener for securing a cylinder.

FIG. 11*b* shows the fastener of FIG. 11*a* in a position where it locks a cylinder against rotation.

FIG. 12 shows a shoe press according to the invention in operation.

DESCRIPTION OF THE PREFERRED EMBODIMENTS

Figure 1:
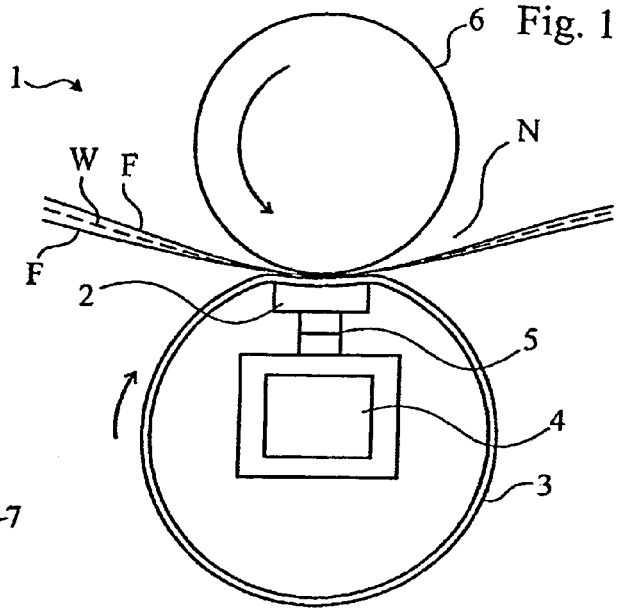
FIG. 1 is a schematic representation of a shoe press for wet pressing.
Figure 13:
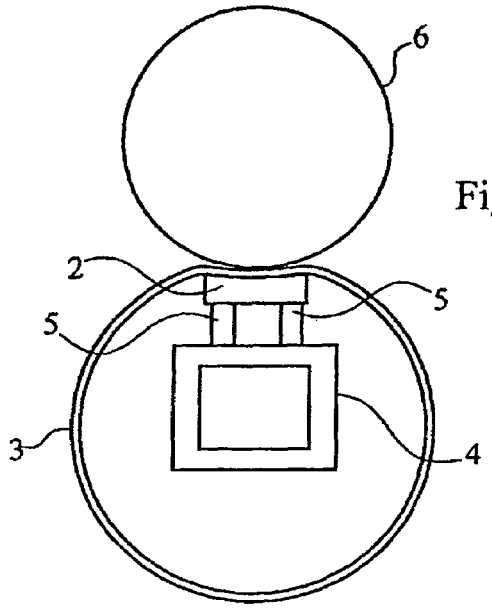
FIG. 13 is a schematic representation of a shoe press where the actuators are placed in two rows spaced apart from each other in the machine direction.

The present invention relates to a shoe press 1 for applying pressure to a fibrous web W. With reference to FIG. 1, the shoe press 1 comprises a concave press shoe 2 which is adapted to be juxtaposed with a backing member 6 such that the web W can be carried through a nip N defined therebetween. It should be understood that the press shoe 2 extends in a cross-machine direction (see FIG. 12) along substantially a full width of the web. The shoe press 1 further comprises a support 4 which supports the press shoe 2. The support 4 may be a cast beam such for example a cast I-beam. The support 4 can also be a welded box-beam 4. The press shoe 2 is movable in a loading direction toward the backing member 6 for applying pressure to the web. For moving the press shoe 2 toward the backing member 6, the shoe press comprises a plurality of articulated hydraulic actuators 5 that are spaced apart in the cross-machine direction along the press shoe 2. The actuators 5 thus form a row that extends in the cross-machine direction. It should be understood that the shoe press could comprise more than one row of actuators 5. In FIG. 13, two rows of actuators 5 are indicated where the two rows are spaced apart in the machine direction.

A rotatable flexible jacket 3 loops the support 4 and the press shoe 2. The jacket 3 (often referred to as belt) is typically made of polyurethane but other materials can also be considered. The ends of the jacket 3 are secured to end walls 8, shown in FIG. 12, that with bearings 33 that allow the end walls 8 and the jacket 3 to rotate. The concave surface of the press shoe 2 is typically lubricated with oil. In FIG. 1, the shoe press 1 is a wet press for dewatering a fibrous web W in the press section of a paper or board machine. In FIG. 1, the web W is shown sandwiched between a pair of water-receiving felts F. For such an application, the machine direction (MD) width of the shoe 2 may typically be about 200-300 mm. The cross-machine width of the shoe 2 may typically be 3-10 m but some shoe presses may be wider than 10 m. In some special applications, for example pilot machines, the shoe 2 may have a width less than 3 meters.

Figure 2:
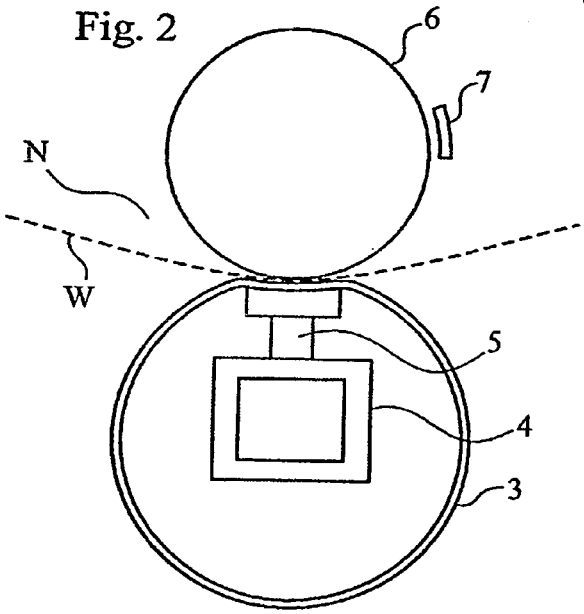
FIG. 2 is a schematic representation of a shoe press used as a calender.

The shoe press 1 of the present invention can also be used as an extended nip calender. FIG. 2 shows a calender configuration where the web W is passed through the nip N without a felt. In the calender configuration, the backing member 6 is a roll 6 that is heated by a heater 7, for example an inductive heater 7. For calender applications, the shoe width in the machine direction may be about 50-70 mm.

Figure 3:
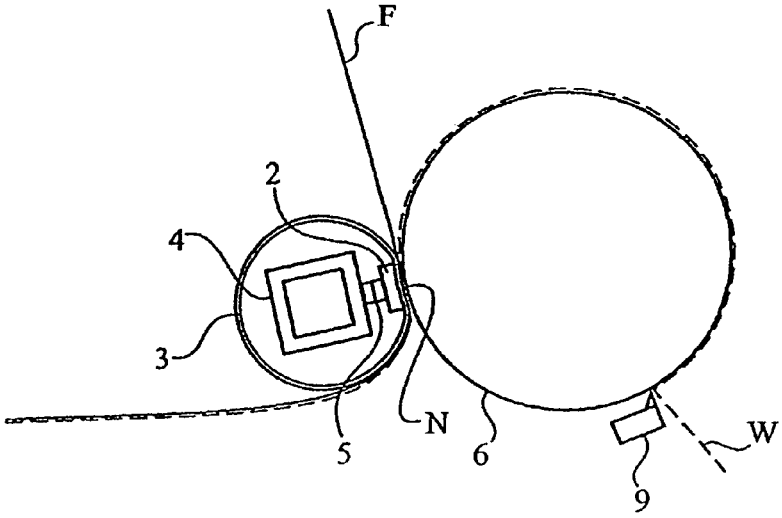
FIG. 3 is a schematic representation of a shoe press in a tissue machine where the backing member is a Yankee dryer.

FIG. 3 shows yet another configuration where the shoe press forms a part of a tissue machine and the backing member 6 is a Yankee dryer 6. In the configuration shown in FIG. 3, the web W is carried on the lower side of a felt F to the nip N where the web is passed over to the surface of the Yankee dryer 6 from which it is creped by a doctor 9. In this kind of application, the MD width of the shoe 2 may be about 100-200 mm.

When the shoe press is used for applying pressure to a web W, frictional heat is generated between the flexible jacket 3 and the shoe 2. Lubrication of the shoe 2 and the interior surface of the belt or jacket 3 is used to reduce friction but friction cannot be entirely eliminated. The shoe 2 is often made of steel or aluminum and will expand in the cross machine direction when it is heated due to friction. The hydraulic actuators 5 must be able to absorb this expansion.

Figure 7:
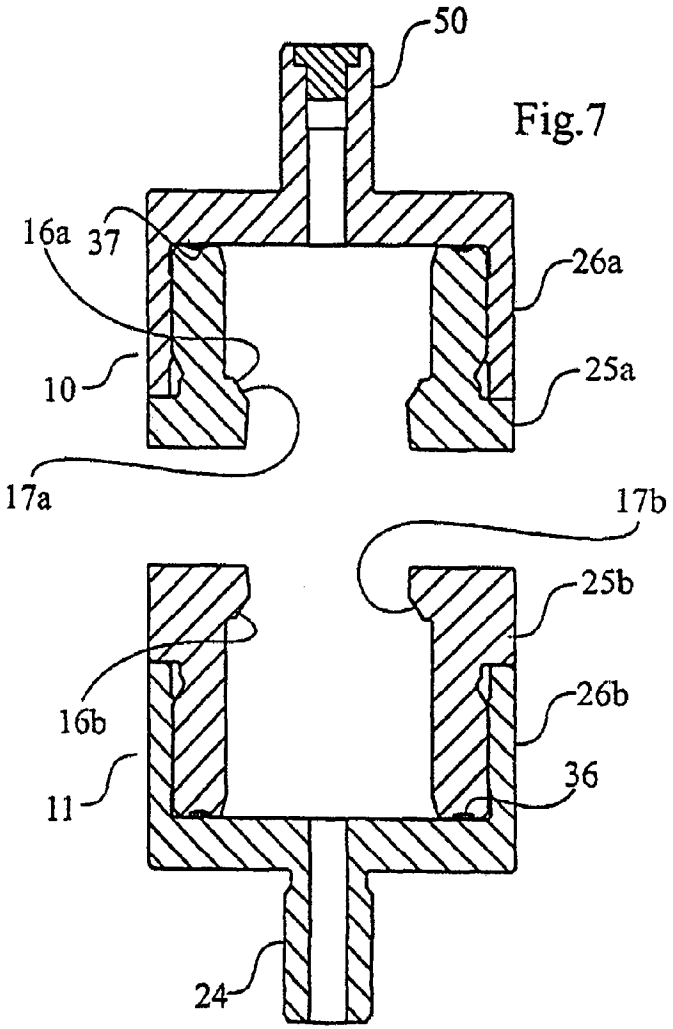
FIG. 7 is a cross sectional view corresponding to FIG. 6 but showing only some of the parts of the actuator.
Figure 6:
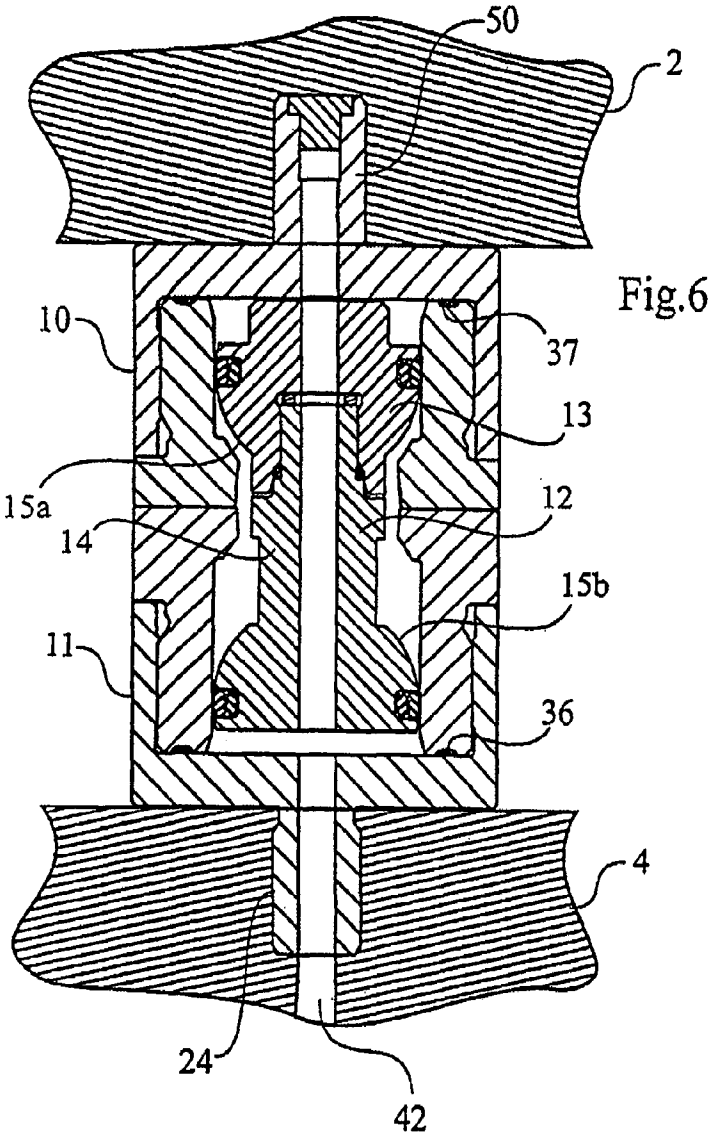
FIG. 6 is a cross sectional view of the assembled hydraulic actuator.

The invention will now be explained with reference to FIG. 6-9. As can be seen in FIG. 6, at least one of the actuators 5 includes a first cylinder 10 which is connected to the press shoe 2, for example by being fixed relative to the press shoe 2 and a second cylinder 11 connected to or fixed relative to the support 4. A piston member 12 has a first end 13 received within the first cylinder 10 and a second end 14 received within the second cylinder 11. The piston ends 13, 14 have convex spherical surfaces 15*a*, 15*b*. As best seen in FIG. 7, the cylinders have seats 16*a*, 16*b* with concave spherical surfaces 17*a*, 17*b*. The concave spherical surfaces 17*a*, 17*b* may have a curvature that corresponds to the curvature of the piston ends 13, 14. Advantageously, the curvature of the piston ends is substantially equal to the curvature of the cylinder seats. However, it is also possible that the curvature of the concave spherical surfaces 17*a*, 17*b* differs from the curvature of the convex spherical surfaces of the piston ends.

The piston spherical surfaces 15*a*, 15*b* of the piston ends allow the piston 12 to pivot in the first and second cylinders 10, 11 about axes parallel to the machine direction to accommodate thermal expansion of the shoe 2 in the cross-machine direction. Hence, the piston 12 will pivot in a plane perpendicular to the machine direction when the shoe is subjected to thermal expansion. In this context, the term "machine direction" should be understood as the direction in which the fibrous web passes the nip. Therefore, the "machine direction" is not necessarily horizontal although this would very often be the case. When the piston 12 pivots about an axis parallel to the machine direction, this means that it will become inclined relative to the loading direction of the shoe press.

The spherical surfaces 15*a*, 15*b* of the piston ends are adapted to cooperate with the concave surfaces 17*a*, 17*b* of the cylinders 10, 11 to prevent the piston 12 from leaving the cylinders 10, 11 when the piston 12 reaches the end of its stroke. At the same time, the cooperating spherical surfaces 15*a*, 15*b*, 17*a*, 17*b* allow the piston to be inclined relative to the loading direction of the actuators even at full (maximum) cylinder stroke of the actuator 5 when the spherical surfaces 15*a*, 15*b* of the piston contacts the spherical surfaces 17*a*, 17*b* of the cylinders 10, 11. If the piston is inclined at its end position, i.e. the position of maximum stroke, the force of the actuator will be distributed over the spherical surfaces 15*a*, 15*b*, 17*a*, 17*b* which significantly reduces the risk that the piston and/or the cylinders will suffer damage if the actuators 5 are pressurized when no backing member 6 is present.

Preferably, each of the articulated actuators 5 has cylinders 10, 11 with concave spherical surfaces 17*a*, 17*b* and a piston 12 with convex spherical surfaces 15*a*, 15*b*.

Figure 4A:
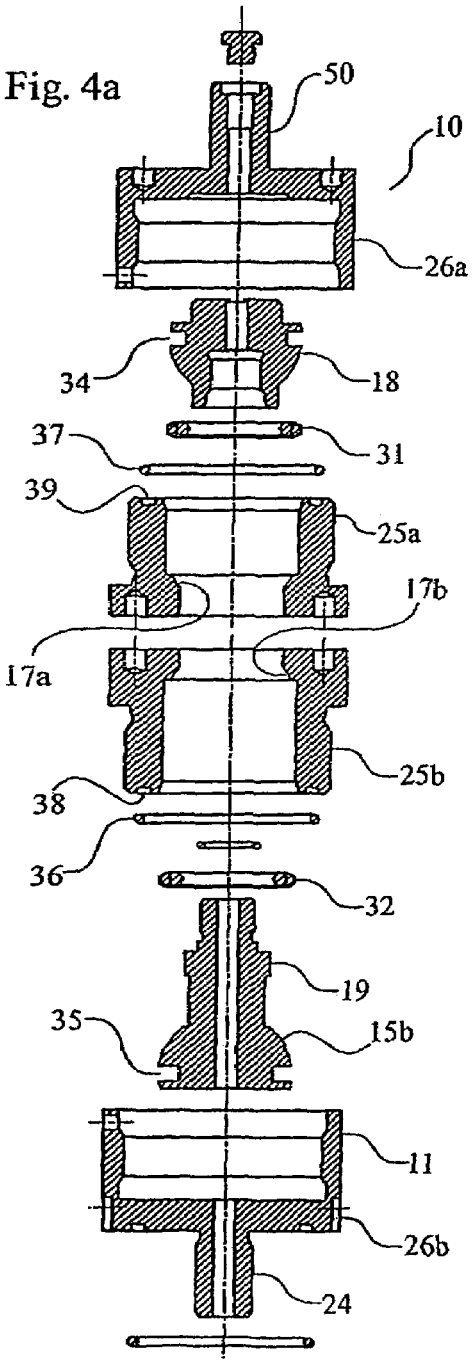
FIG. 4*a* is a cross section of a disassembled hydraulic actuator for a shoe press.
Figure 4B:
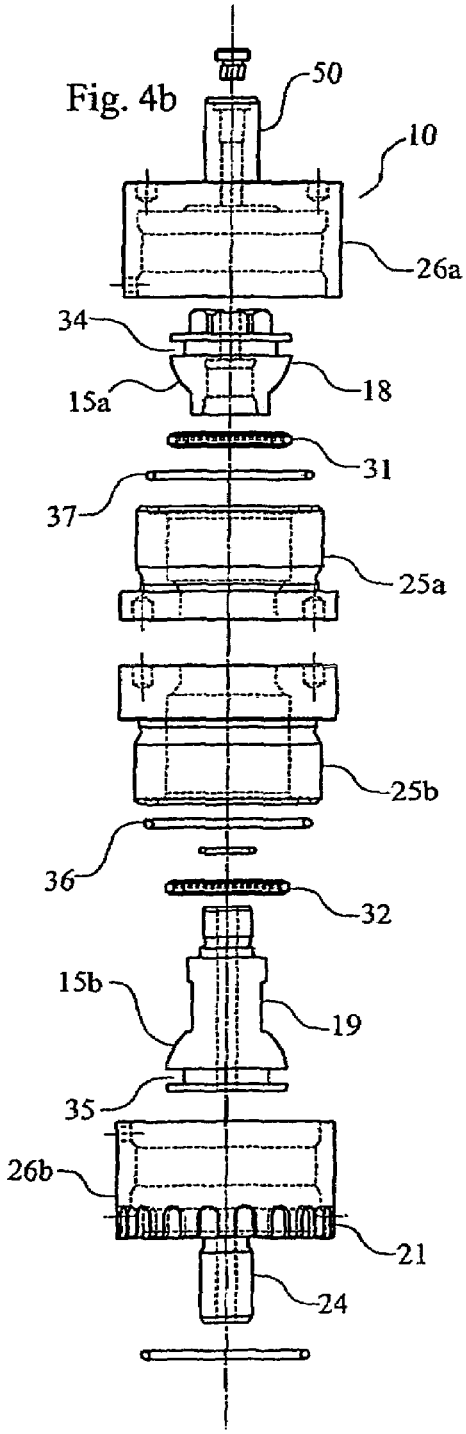
FIG. 4*b* is an exploded view of a hydraulic actuator for a shoe press.

The components of the actuator can be seen in detail in FIG. 4*a* and FIG. 4*b*. As best seen in FIGS. 4*a* and 4*b*, the piston 12 can comprise two separate parts 18, 19 adapted to be connected to each other, e.g. by being screwed together. For example, an external threading on the lower piston part 19 of FIG. 4*b* can cooperate with an internal threading in the upper piston part 18 of FIG. 4*b*. In FIGS. 6, 8, 9 5 and 10, the piston parts 18, 19 are showed connected to each other. In FIGS. 4*a* and 4*b*, it can also be seen that the first cylinder 10 may comprise an external cylinder part 26*a* and an internal cylinder part 25*a*. In the same way, the second cylinder 11 may comprise an external cylinder part 26*b* and an internal cylinder part 25*b*. The internal cylinder parts 25*a*, 25*b* can be secured in the external cylinder parts 26*a*, 26*b*, e.g. by screwing. Therefore, the internal cylinder parts 25*a*, 25*b* may have an external threading while the external cylinder parts 26*a*, 26*b* have an internal threading that matches the threading of the internal cylinder parts. The second cylinder 11 may have at its bottom a pin 24 that may have an external threading that enables the second cylinder 11 to be secured in a threaded hole in the support 4. Sealing rings 31, 32 are provided for the piston 12 and can be fitted in channels 34, 35. Sealing rings 36, 37 may be fitted in channels 38, 39 to provide a seal between the internal cylinder parts 25*a*, 25*b* and the external cylinder parts 26*a*, 26*b*. In the embodiment shown in FIG. 4*a*, the concave spherical surfaces 17*a*, 17*b* of the cylinders 10, 11 are formed on a part of the internal cylinder parts 25*a*, 25*b*.

As indicated in for example FIG. 6, the first cylinder 10 may have a pin 50 that can engage a hole in the shoe 2 to secure the first cylinder to the shoe 2. It is possible that the first cylinder 10 can be secured to the shoe in such a way that it is rigidly locked to the shoe 2. For example, it can be screwed to the shoe 2. However, it is also possible and sometimes preferable that the pin 50 only secures the first cylinder to the shoe 2 in the machine direction and the cross machine direction but that the shoe 2 can be simply lifted off from the pin 50 (or pins 50) and thereby also from the actuators 5. For this reason, the pin 50 may have smooth surface and the hole in the shoe 2 that receives the pin 50 may be somewhat larger than the pin. In principle, it is possible to envisage similar solutions for the second cylinder 11.

To assemble the actuator shown in FIG. 4*b*, the lower piston part 19 is placed inside the internal cylinder part 25*b* such that the convex spherical surface 15*b* of the piston part 19 faces the concave spherical surface 17*b* of the internal cylinder part 25*b*. The sealing ring 32 has already been placed in the channel 35 of the piston part 19. The sealing ring 36 is fitted in the channel 38 on a bottom face of the internal cylinder part 25*b*. The internal cylinder part 25*b* is then placed in the external cylinder part 26*b* and secured to the external cylinder part 26*b*, e.g. by screwing. In the same way, the upper piston part 18 can be placed in the upper internal cylinder part 25*a* with the convex spherical surface 15*a* facing the concave spherical surface 17 of the upper internal cylinder part 25*a* (the term "upper" only refers to what is the "upper" part in the figure). With the sealing ring 37 in place in the channel 39, the internal cylinder part 25*a* can then be placed in the external cylinder part 26*a* and secured to the external cylinder part 26*a*. Either before or after the internal cylinder part 25*a* is placed in the external cylinder part 26*b*, the piston parts 18, 19 are connected to each other. The assembled actuator 5 is shown in perspective in FIG. 5.

Figure 8:
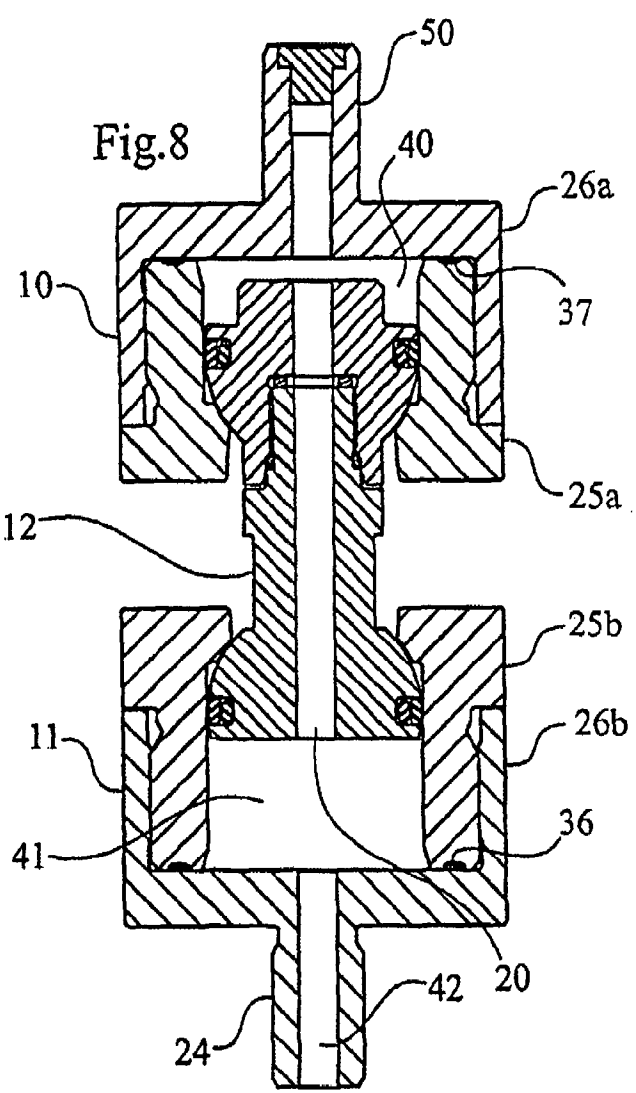
FIG. 8 is a cross sectional view corresponding to FIG. 6 but with the hydraulic actuator shown at the limit of its stroke.

Preferably, the piston 12 is provided with a through-hole 20 such that the first cylinder 10 is in fluid communication with the second cylinder 11. As can be seen in FIG. 8, a first working chamber 40 is defined by the piston 12 and the first cylinder 10. A second working chamber 41 is defined by the piston 12 and the second cylinder 11. The through-hole 20 allows fluid communication between the working chambers 40, 41. Hydraulic fluid (such as hydraulic oil) can be supplied through the channel 42 to pressurize the working chambers 40, 41. It should be understood that, in some embodiments, the working chambers 40, 41 could also be pressurized independently of each other. In such embodiments, the piston 12 would have no through-hole 20.

Figure 9:
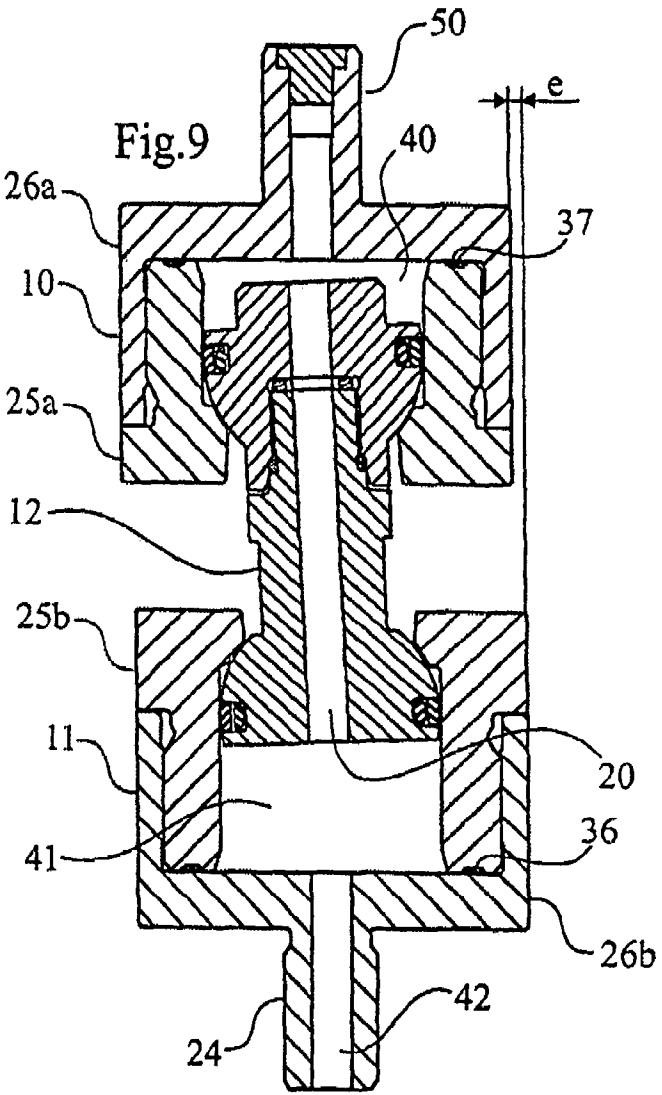
FIG. 9 is a cross sectional view corresponding to FIG. 8 and additionally illustrating the effect of thermal expansion of the shoe.

The function of the inventive shoe press will now be explained with reference to FIG. 6, FIG. 8, FIG. 9 and FIG. 12. FIG. 6 illustrates a situation where the actuator 5 is not pressurized or only slightly pressurized. The first cylinder 10 is shown resting on the second cylinder 11. The convex spherical surfaces 15*a*, 15*b* of the piston 12 are not in contact with the concave spherical surfaces 17*a*, 17*b* of the cylinders. FIG. 8 illustrates a situation where the working chambers 40, 41 of the actuator 5 have been pressurized, e.g. through the channel 42. The cylinders 10,11 have been separated from each other and the convex spherical surfaces 15*a*, 15*b* of the piston 12 have reached the concave spherical surfaces 17*a*, 17*b* of the cylinders 10, 11. This prevents further movement of the piston 12 relative to the cylinders 10, 11. Hence, if the actuators 5 have been pressurized in a situation where no backing member 6 is present, this will not cause the actuators to fall apart. It should be understood that, during normal operation, the piston 12 will not necessarily reach the position indicated in FIG. 8 where the piston has reached its maximum stroke. FIG. 9 illustrates a situation where the actuators 5 are extended at maximum stroke as in FIG. 8 and where the concave shoe has expanded in the cross machine direction as a result of frictional heat generated during operation of the shoe press. The expansion of the shoe means that an actuator 5 must be able to absorb a cross-machine direction elongation e as indicated in FIG. 9. This is possible since the spherical surfaces 15*a*, 15*b* of the piston 12 can cooperate with the spherical surfaces 17*a*, 17*b* of the cylinders 10, 11. Therefore, the piston 12 can pivot about an axis parallel to the machine direction as indicated in FIG. 9 and thereby become inclined relative to the loading direction of the shoe. As indicated in FIG. 12, actuators S have reacted to the elongation of the shoe all along the cross machine direction of the shoe 2. The actuator or actuators 5 at the middle of the shoe have reacted little or not at all while the actuators at the edges have absorbed a relatively large elongation.

Figure 14:
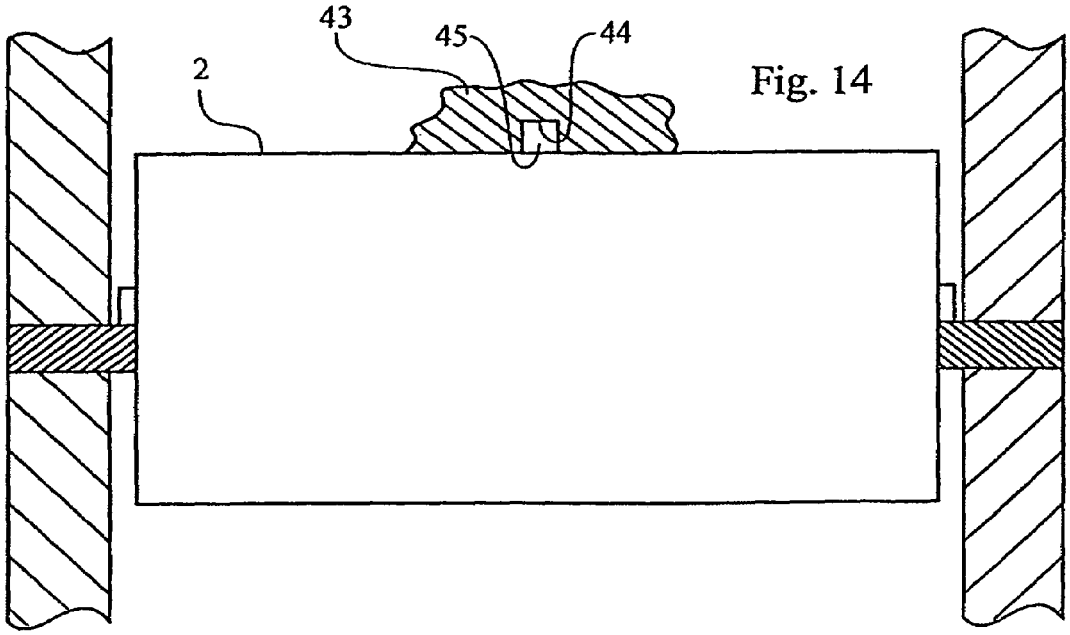
FIG. 14 is a top elevation of a shoe press showing a possible embodiment where a pin at the downstream edge of the shoe is used for restraining motion of the shoe.

With reference to FIG. 14, the shoe press may comprise a downstream support 43 for the shoe 2 to absorb forces in the machine direction. In FIG. 14, it is indicated that the downstream support 43 may have a slot 44 that extends in the loading direction while a pin 45 may be located at a midpoint of the width of the shoe to engage the slot 44. Alternatively, the slot may be located in the shoe 2. In this way, the shoe 2 is free to move toward and away from the backing member but restrained from moving in the cross-machine direction as described in U.S. Pat. No. 6,083,352. Hence, thermal expansion of the shoe 2 in the cross-machine direction does not all occur in a single direction but rather occurs in opposite directions on either side of the longitudinal centerline of the shoe.

It should be understood that, during normal operation, thermal expansion of the shoe 2 will cause the piston 12 to pivot well before it has reached its full stroke length. It should also be understood that, during normal operation, the piston 12 may possibly never reach its full stroke length. The situation illustrated in FIG. 9 can therefore be understood as an extreme situation.

An alternative embodiment will now be explained with reference to FIG. 10. As explained with reference to FIGS. 4*a* and 4*b*, each of the first and second cylinders 10, 11 may comprise an internal cylinder part 25*a*, 25*b* and an external cylinder part 26*a*, 26*b* detachably secured to each other. In the embodiment illustrated in FIGS. 4*a*, 4*b* and 6-9, the concave spherical surfaces of the cylinders 10, 11 are formed on the internal cylinder parts 25*a*, 25*b*. This makes it necessary to use sealing rings 36, 37 between the internal cylinder parts 25*a*, 25*b* and the external cylinder parts 26*a*, 26*b* as indicated in FIG. 8 and FIG. 9. In the embodiment shown in FIG. 10, the concave spherical surfaces 17*a*, 17*b* have been formed on the external cylinder parts 26*a*, 26*b*. In this embodiment, the sealing rings 36, 37 between the internal cylinder parts 25*a*, 25*b* and the external cylinder parts 26*a*, 26*b* can be eliminated since the contact area between the cylinder parts does not risk being exposed to pressurized hydraulic fluid. In this embodiment, the concave spherical surface 17*a*, 17*b* of at least one cylinder part should be located on a part of the external cylinder 26.

Figure 10:
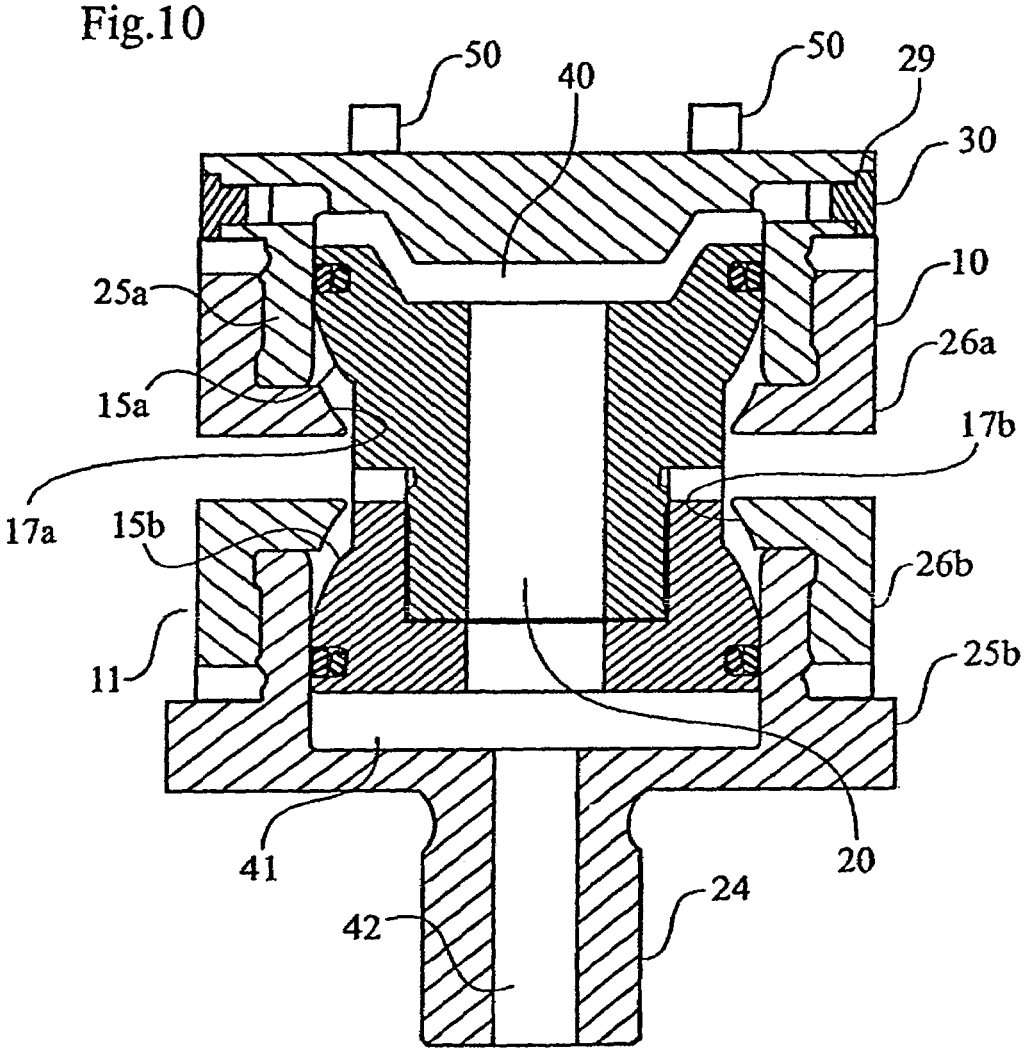
FIG. 10 shows, in cross section, an alternative embodiment of the hydraulic actuator.

In FIG. 10, it can also be seen that one of the cylinders 10, 11 can be provided with a venting opening 29 with a removable plug 30. This may also be applicable to the embodiment of FIGS. 4-9.

Figure 5:
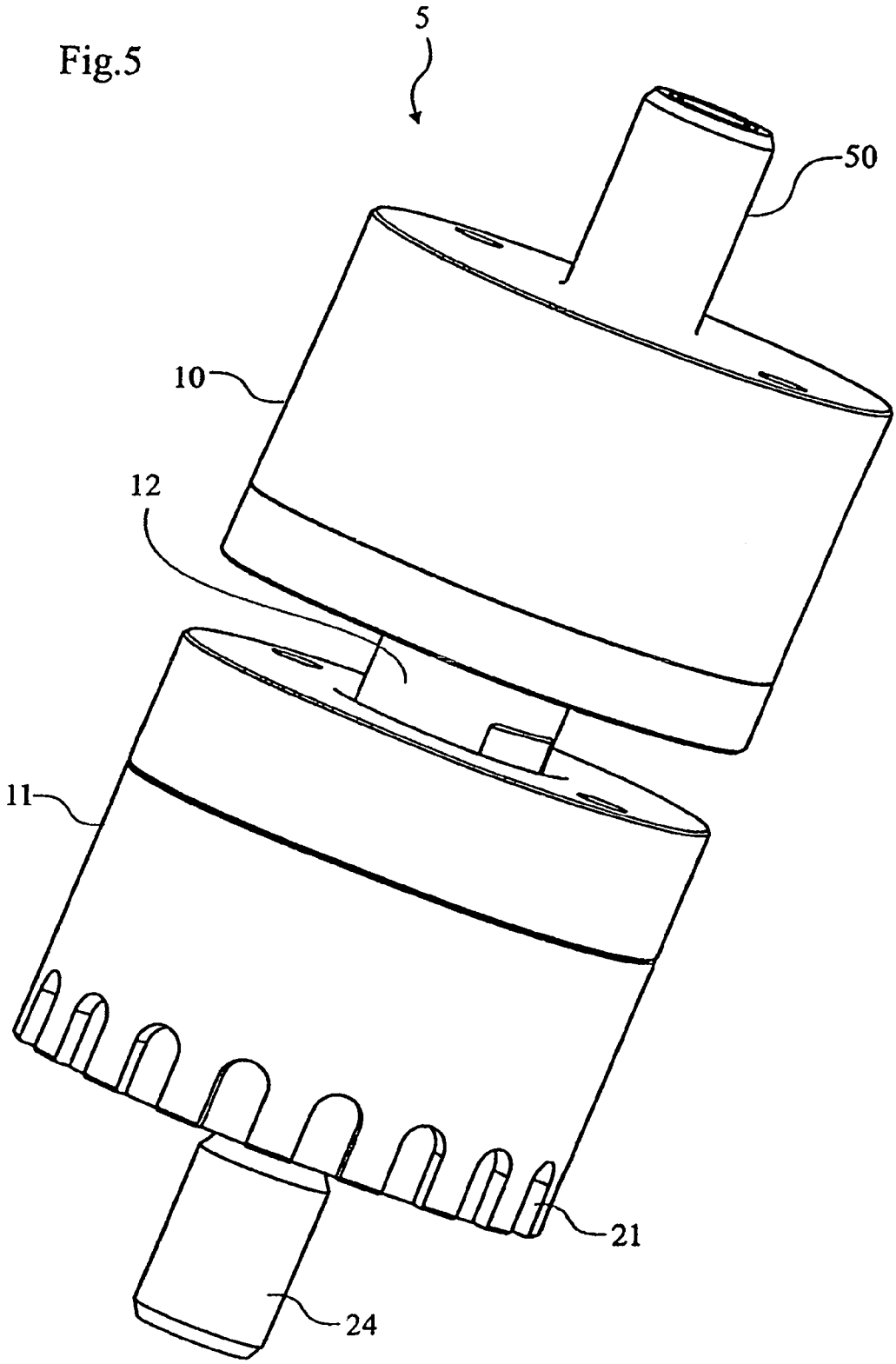
FIG. 5 is a perspective view that shows the hydraulic actuator of FIGS. 4*a* and 4*b* after it has been assembled.

As can be seen in for example FIG. 5, one of the cylinders 10, 11 has a serrated outer circumference 21. In FIG. 5, it is the second cylinder 11 that has a serrated outer circumference but it should be understood that also the first cylinder could have a serrated outer circumference.

During assembly of the shoe press 1, the serrated outer circumference 21 of the cylinder 11 can be used to obtain a good grip on the cylinder 11 when the cylinder 11 is secured to the support 4. The cylinder 11 is typically screwed to the support or support beam 4 by means of the threaded pin 24. During the screwing operation, the serrated outer circumference makes it easier to obtain a good grip in the cylinder 11.

Reference will now be made to FIG. 11*a* and FIG. 11*b*. Once the second cylinder 11 has been rotated into locking engagement with the support 4 (e.g. by screwing), the serrated outer circumference 21 of the second cylinder 11 will be located at a lower end of the second cylinder 11 adjacent the support 4. In FIG. 11*b*, it can be seen that a fastener 22 which is removably secured to the support 4 engages the serrated outer circumference 21 to prevent rotation of the second cylinder 11 relative to the support 4. The fastener 22 is shown in perspective in FIG. 11*a*. A small screw-hole (not shown) may be located adjacent the position of the second cylinder 11. Once the second cylinder has been screwed to the support, the fastener 22 is placed over the small screw-hole to engage the serrated outer circumference 21. The fastener 22 can then be screwed to the support 4 to keep the cylinder 11 in place.

The dimensions of the actuators depend on the particular application of the shoe press. In a wet press, the shoe 2 is relatively wide in the machine direction. At a given nip pressure, the linear load must be correspondingly high. Therefore, relatively large dimensions are required when the shoe press 1 is used as a wet press. When the shoe press is used as an extended nip calender, i.e. a shoe calender, the linear load is typically lower and the dimensions of the actuators is normally smaller.

The invention confers, inter alia, the advantage that the actuators can take their own force, even at maximum stroke and also when the pistons have pivoted as a result of thermal expansion of the shoe. The cooperating spherical surfaces increases the ability of the actuators to take their own force. The inventor has found that the design according to the present invention allows the pistons to pivot to an angle of up to about 4° and possibly even more. The risk that the pistons leave their cylinders if the actuators are loaded when no backing member is present is eliminated.

If the piston is divided into two parts, this will confer the advantage that assembly of the actuator becomes easier. When the cylinders are divided into external and internal cylinder parts, this will also make it easier to assemble the actuator and connect it to the shoe and support.

The invention can also be defined in terms of a method for assembling the hydraulic actuator described above.

I claim:

1. A shoe press for applying pressure to a fibrous web, the shoe press comprising:

a concave press shoe arranged to be juxtaposed with a backing member to define a nip therebetween such that the web can be carried through the nip, the press shoe extending in a cross-machine direction along substantially a full width of the web;

a support supporting the press shoe, wherein the press shoe is mounted for movement on the support in a loading direction toward the backing member so that the shoe can apply pressure to the web passing through the nip;

a plurality of articulated hydraulic actuators spaced apart in the cross-machine direction along the press shoe, at least one actuator including a first cylinder connected to the press shoe, a second cylinder connected to the support and a piston member having a first end received within the first cylinder and a second end received within the second cylinder wherein the piston ends have convex spherical surfaces and the cylinders have portions defining concave spherical surfaces forming seats arranged to cooperate with the convex spherical surfaces of the piston ends so that the piston is inclinable relative to the loading direction even at full cylinder stroke and wherein the convex spherical surfaces and the concave spherical surfaces cooperate to prevent the piston from leaving the cylinders, wherein the piston comprises two parts which can be connected and disconnected from each other.

2. A shoe press for applying pressure to a fibrous web, the shoe press comprising:

a concave press shoe arranged to be juxtaposed with a backing member to define a nip therebetween such that the web can be carried through the nip, the press shoe extending in a cross-machine direction along substantially a full width of the web;

a support supporting the press shoe, wherein the press shoe is mounted for movement on the support in a loading direction toward the backing member so that the shoe can apply pressure to the web passing through the nip;

a plurality of articulated hydraulic actuators spaced apart in the cross-machine direction along the press shoe, at least one actuator including a first cylinder connected to the press shoe, a second cylinder connected to the support and a piston member having a first end received within the first cylinder and a second end received within the second cylinder wherein the piston ends have convex spherical surfaces and the cylinders have portions defining concave spherical surfaces forming seats arranged to cooperate with the convex spherical surfaces of the piston ends so that the piston is inclinable relative to the loading direction even at full cylinder stroke and wherein the convex spherical surfaces and the concave spherical surfaces cooperate to prevent the piston from leaving the cylinders, wherein the second cylinder has an outer circumference, portions of which are serrated.

3. The shoe press of claim 2, wherein the second cylinder has been rotated into locking engagement with the support, and wherein the serrated outer circumference of the second cylinder is located at a lower end of the second cylinder adjacent the support and further comprising a fastener removably secured to the support which engages the serrated outer circumference to prevent rotation of the second cylinder relative to the support.

4. A shoe press for applying pressure to a fibrous web, the shoe press comprising:

a concave press shoe arranged to be juxtaposed with a backing member to define a nip therebetween such that the web can be carried through the nip, the press shoe extending in a cross-machine direction along substantially a full width of the web;

a support supporting the press shoe, wherein the press shoe is mounted for movement on the support in a loading direction toward the backing member so that the shoe can apply pressure to the web passing through the nip;

a plurality of articulated hydraulic actuators spaced apart in the cross-machine direction along the press shoe, at least one actuator including a first cylinder connected to the press shoe, a second cylinder connected to the support and a piston member having a first end received within the first cylinder and a second end received within the second cylinder wherein the piston ends have convex spherical surfaces and the cylinders have portions defining concave spherical surfaces forming seats arranged to cooperate with the convex spherical surfaces of the piston ends so that the piston is inclinable relative to the loading direction even at full cylinder stroke and wherein the convex spherical surfaces and the concave spherical surfaces cooperate to prevent the piston from leaving the cylinders wherein each of the first and second cylinders comprises an internal cylinder part and an external cylinder part externally positioned with respect to the internal cylinder part and detachably secured to the internal cylinder part.

5. The shoe press of claim 4, wherein the concave spherical surface of at least one of the first and second cylinders is located on the external cylinder part.

6. A shoe press for applying pressure to a fibrous web, the shoe press comprising:

a concave press shoe adapted to be juxtaposed with a backing member such that the web can be carried through a nip defined therebetween, the press shoe extending in a cross-machine direction along substantially a full width of the web;

a support which supports the press shoe such that the press shoe is movable in a loading direction toward the backing member for applying pressure to the web;

a plurality of articulated hydraulic actuators spaced apart in the cross-machine direction along the press shoe, wherein each actuator comprises:

a piston member;

a first cylinder connected to the press shoe, the first cylinder having an internal cylinder part connected to an external cylinder part, wherein the piston member has a first end received within the first cylinder, the piston member first end having portions defining a convex spherical surface, and wherein one of the internal cylinder part and the external cylinder part has portions defining a seat having portions defining a concave spherical surface adapted to cooperate with the convex spherical surface of the piston member first end;

a second cylinder connected to the support, the second cylinder having an internal cylinder part connected to an external cylinder part, wherein the piston member has a second end received within the second cylinder, the piston member second end having portions defining a convex spherical surface, and wherein one of the second cylinder internal cylinder part and external cylinder part has portions defining a seat having portions defining a concave spherical surface adapted to cooperate with the convex spherical surface of the piston member second end, the engagement between the piston member and the first and second cylinder allowing the piston member to be inclined relative to the loading direction even at full cylinder stroke but prevent the piston from leaving the cylinders.

7. The shoe press of claim 6 wherein the piston member comprises:

a first part having portions defining the first end; and a second part having portions defining the second end, wherein the first part is connected to the second part.

8. The shoe press of claim 6, wherein the piston member has a through-hole such that the first cylinder is in fluid communication with the second cylinder.

9. The shoe press of claim 6, wherein the second cylinder has a serrated outer circumference.

10. The shoe press of claim 9, wherein the second cylinder has been rotated into locking engagement with the support, and wherein the serrated outer circumference of the second cylinder is located at a lower end of the second cylinder adjacent the support and further comprising a fastener removably secured to the support which engages the serrated outer circumference to prevent rotation of the second cylinder relative to the support.

11. The shoe press of claim 6, wherein the concave spherical surface of at least one cylinder is located on a part of an external cylinder.

12. The shoe press of claim 6, wherein one of the cylinders has portions defining a venting opening.

* * * * *